US006859617B2

(12) United States Patent
Goodsel et al.

(10) Patent No.: US 6,859,617 B2
(45) Date of Patent: Feb. 22, 2005

(54) POROUS THIN FILM HEATER AND METHOD

(75) Inventors: Arthur J. Goodsel, St. Clair, MI (US); Jay DeDontney, Prunedale, CA (US)

(73) Assignee: Thermo Stone USA, LLC, Marina, CA (US)

( * ) Notice: Subject to any disclaimer, the term of this patent is extended or adjusted under 35 U.S.C. 154(b) by 261 days.

(21) Appl. No.: 09/931,307

(22) Filed: Aug. 16, 2001

(65) Prior Publication Data

US 2002/0104836 A1 Aug. 8, 2002

Related U.S. Application Data

(60) Provisional application No. 60/227,562, filed on Aug. 17, 2000.

(51) Int. Cl.[7] ..... H05B 3/40
(52) U.S. Cl. ..... 392/478; 219/543
(58) Field of Search ..... 392/465, 466, 392/476; 219/543

(56) References Cited

U.S. PATENT DOCUMENTS

| | | | | |
|---|---|---|---|---|
| 5,058,196 A | * | 10/1991 | Nakamura et al. | 392/435 |
| 5,122,391 A | | 6/1992 | Mayer | |
| 5,616,266 A | | 4/1997 | Cooper | |
| 5,830,530 A | * | 11/1998 | Jones | 427/248.1 |
| 6,072,165 A | | 6/2000 | Feldman | |
| 6,242,722 B1 | | 6/2001 | Provancha et al. | |
| 6,376,816 B2 | * | 4/2002 | Cooper et al. | 219/543 |

* cited by examiner

*Primary Examiner*—Thor Campbell
(74) *Attorney, Agent, or Firm*—Dorsey & Whitney LLP

(57) ABSTRACT

A resistance heater for heating fluids including a fluid-permeable porous substrate. An electrically conductive porous thin film is deposited on the porous substrate. An electrical connector coupled to the thin film and adapted to provide an electrical circuit through said thin film to effect heating of said thin film in order to heat a fluid passing through the pours of the thin film and substrate. A method of making and using a resistance heater is also disclosed.

20 Claims, 2 Drawing Sheets

POROUS THIN FILM HEATER AND METHOD

RELATED APPLICATIONS

This application claims priority to U.S. Provisional Patent Application No. 60/227,562 filed Aug. 17, 2000, entitled Porous Thin Film Heater and Method, the entire contents of which is incorporated herein by this reference.

BACKGROUND OF THE INVENTION

1. Field of the Invention

The present invention relates, in general, to fluid heating apparatus and methods, and more particularly, relates to thin film heaters formed by the growth or deposition of an electrically conductive thin film on a supporting electrically insulating substrate and the use of such thin film heaters to heat fluids.

2. Description of Related Art

There are several ways of heating fluids, but most employ a heater element operating at a relatively high temperature because the contact time between the gas or liquid and the heating element is often minimal. Thus, in fluid heating there is often a trade off between fluid contact time and heating element temperature in which temperature is often easier to increase as a practical matter than is contact time. This trade off is present for a wide variety of heaters including thin film resistance heaters.

Resistance heating of fluids using thin films deposited upon mechanically supportive substrates is well known in the art. Typical of such prior art devices are the thin film heating devices shown in U.S. Pat. No. 5,616,266 to Cooper (the "Cooper '266 Patent"). The resistance heaters disclosed in the Cooper '266 Patent includes a flow-through louvered heater in which a gas, usually air, flows through louvers having a thin film heater deposited thereon.

In the louvered heater, of the Cooper '266 Patent, however, most of the fluid passing through the heater is not actually in direct contact with the thin film. The boundary layer of gases contacts the film on the louvers, but most of the gases simply flow through the openings defined by the louvers.

Typically, thin film heaters, and specifically the heater of the Cooper '266 Patent, are deposited on smooth substrates such as glass, quartz alumina, mica, ceramic, porcelainized steel materials, etc. These types of materials are well suited as they provide an electrically insulating surface for the electrically conductive thin film heater to be applied to, as well as possessing desirable high temperature self-supporting physical properties necessary for a heater. A common feature of these prior art substrate materials is that they are non-porous and have a smooth surface finish. Smooth substrate surfaces minimize turbulence within the film deposition reactor, which if present, can lead to uneven thickness of the deposited film, and/or other undesirable qualities.

SUMMARY OF THE INVENTION

In summary, one aspect of the present invention is directed to a resistance heater including a fluid-permeable porous substrate, an electrically porous conductive thin film deposited on the porous substrate and an electrical connector coupled to the thin film. The electrical connector is adapted to provide an electrical circuit through the thin film to effect heating of the thin film.

Another aspect of the present invention is directed to a resistance heater including a tubular housing, a tubular and fluid-permeable porous substrate disposed within the tubular housing, and an electrically conductive thin film deposited as a porous surface on the porous substrate. First and second bus bars proximal first and second ends of the porous substrate, respectively, are electrically coupled to the thin film. A fitting secures the first end of the porous substrate relative to the tubular housing. The fitting includes a central bore. First and second electrical conductors are electrically connected to the first and second bus bars, respectively, and the conductors pass axially through the fitting and are adapted to be coupled with a source of electricity. A closure member closes the second end of the porous substrate wherein fluid passing through the resistance heater passes through the fitting bore, the porous substrate and the tubular housing, respectively.

Yet another aspect of the present invention is directed to a method of forming a resistance heater including the steps of providing a fluid-permeable porous substrate, depositing an electrically conductive thin film on the porous substrate to provide a porous thin film supported on the porous substrate, and coupling an electrical connector to the thin film to provide a circuit through the thin film.

Accordingly, it is an object of the present invention to provide a thin film resistance heater and method in which the trade off between fluid contact time and heating element temperature is better optimized.

Another object of the present invention is to provide a porous thin film resistance heater and method which can be used to simultaneously filter and or disperse fluids being heated.

Still another object of the present invention is to provide a porous thin film resistance heater and method which are adaptable to wide range of fluid heating applications, are efficient in the heating of fluids, and can be formed and used relatively inexpensively.

The porous thin film fluid heating apparatus of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

In the resistance thin film heater of the present invention, an electrically conductive thin film is deposited on a porous substrate to create a porous heating element, instead of the usual smooth substrate, and fluid, a gas or liquid, is caused to flow through the porous film and substrate so as to increase the amount of contact and increase the contact time of the fluid with the heater element.

Figure 1:
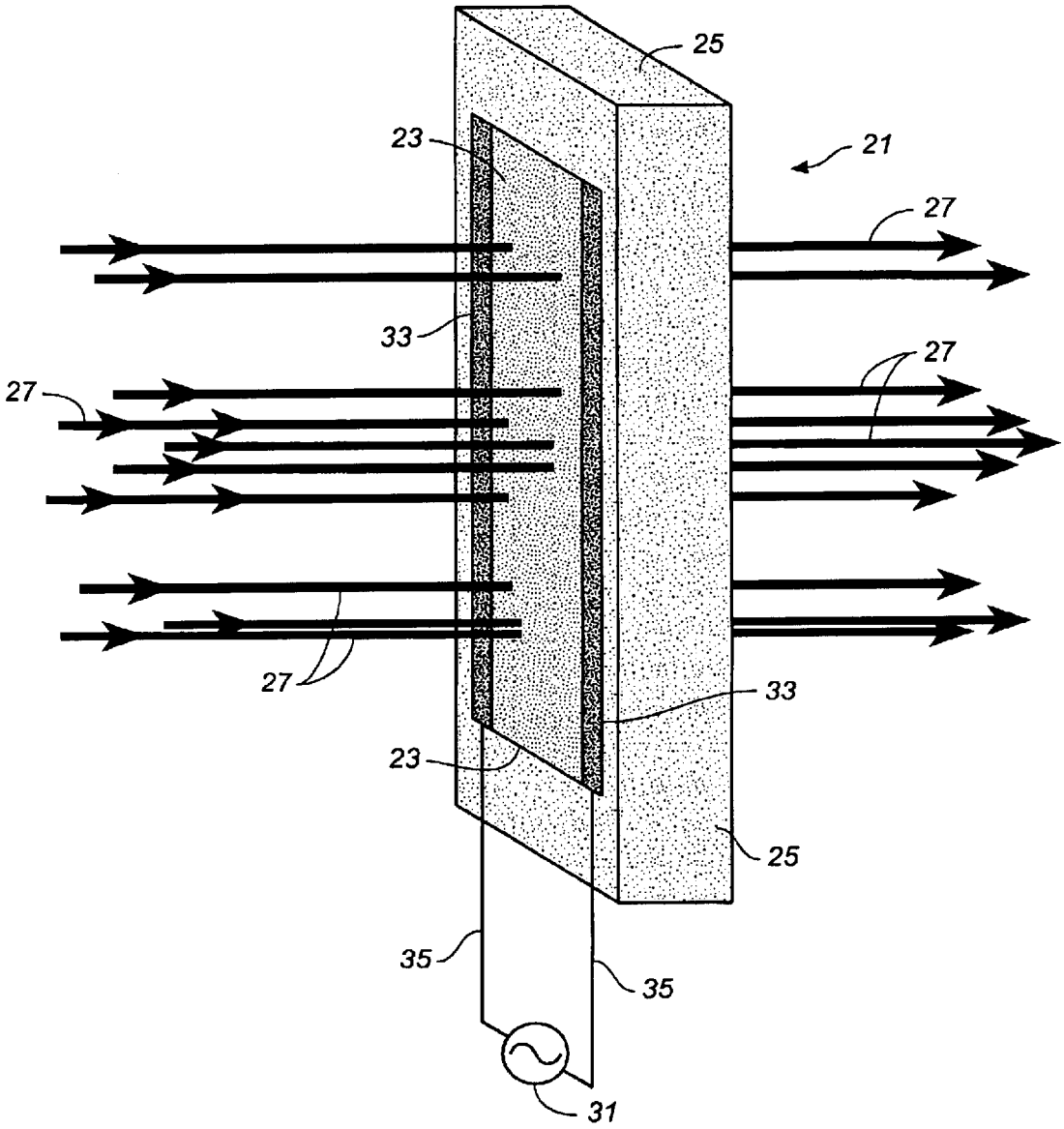
FIG. 1 is a top perspective view of a porous thin film heater constructed in accordance with the present invention.

Referring now to FIG. 1, a thin film based resistance heater, generally designated 21, is shown in which thin electrically conductive film 23 is shown as deposited or grown on rigid or self-supportive porous substrate 25. Substrate 25 can be provided by many materials, such as metals (Mott Metallurgical products for example), ceramics (Refractron Technologies Corporation products for example), glasses, glass ceramics, composites, aerogels, quartz and possibly other materials yet to be devised. Suitable substrate materials currently are used for filtering liquids and gases, diffusing, distributing or spreading out liquids and gases, or providing mechanical properties at a minimum weight. By replacing the solid substrates as typically used in thin film heaters with porous substrate 25, thin film heater 21 can incorporate desirable properties of the porous substrate materials.

Heater film 23 is porous itself preferably as a result of being "grown" on the surface of porous substrate 25. Film 23 is necessarily "thin," so that it is possible to retain the properties of porous material 25. This combined porous film and substrate structure can then be utilized to effect heat transfer to fluids, schematically shown by arrows 27, while at the same time and within the same structure, providing a filtering or diffusing action. Heater 21 also can be used in applications in which heat is to be transferred to a fluid in a load bearing structure having minimum weight, such as might be required in an application in which temperature is to be controlled in an apparatus positioned outside the Earth's atmosphere.

The phrase "porous substrate" is meant to describe a material that posses an open-cell structure or a material in which voids exist such that there are multiplicity or extremely large number of small diameter paths or connected cells through the material. Yet substrate material 25 should also exhibit structural properties, such as the necessary strength to resist externally applied forces. Suitable porous substrate materials are used extensively, for example, as diffusers, filters, etc.

Porous substrates are well suited for processing in a film growing or depositing reactor in which thin films 23 can be deposited on substrates 25. Porous substrates can be described by two numbers: the porosity of the material, and the pore size, although other measures may exist. The porosity is the ratio of weight of the porous material to that of the same size material in solid form. It is a measure of total "openness" of substrate material 25. The porous substrates of the present invention generally have a range of porosity between approximately 10% and 60%, and preferably between 20% and 50%. One should appreciate that other porosities can be used in accordance with the present invention.

An alternative criteria might be the number of pores per unit volume. The pore size is a measure of the average size of the voids, and can be used to characterize the largest object that might pass through the structure. Porous substrate materials used as filter elements are typically rated as to their pore size. The pressure required to pass a media through a given porous substrate material is dependant upon the pore size, the porosity, and the thickness of the filter or diffuser, so pressure may be an alterative unit used to characterize such materials. The void/pore sizes in substrate materials 25 suitable for use in heater 21 range from approximately 0.5 microns (5000 Angstroms) to 50 microns (50,000 Angstroms) to pore sizes as large as a fraction of an inch (e.g., 1/64 inch). One should appreciate that other pore sizes can be utilized in accordance with the present invention.

In practice, porous substrate material may be metal, ceramic, glass or other structural material able to be self-supporting while withstanding the temperatures used in the thin film heaters (for example, 100–400° C.) and the temperatures used in growth/deposition reactors. One should appreciate that the term self-supporting is used to indicate that the porous substrate material has a degree of structural integrity or rigidity which allows it to stand alone and maintain its shape. The surface of substrate 25 must be suitable for the deposit of an electrically conductive thin film. Thus, if a porous electrically conductive metal substrate 25 is used, the surface should first have a thin electrically insulating material (not shown) such as $SiO_2$, or other dielectric material which does not clog the pores, deposited on it before electrically conductive film 23 is deposited on such surface. The porous substrate may be tubular, a disk, a block, sheet or molded form.

Thin films which are electrically conductive and can be used as resistance heating elements are well known in the art. Such films are disclosed, for example, in the Cooper '266 Patent, which is incorporated herein by reference. Thus, film 23 can be tin oxide and doped tin oxide created from independent precursors such as tin chloride, methyl alcohol, $H_2O$, and dopants DFE such as di-flouroethane (DFE) and antimony pentachloride. Film 23 may be formed by reacting vaporous raw material precursors together in a high temperature process reactor, in a variant of the method described in U.S. Pat. No. 5,122,391 to Mayer, which is incorporated herein by reference.

As the reaction occurs within the process reactor, substrates 25 to be "coated" with film 23 are conveyed through the reaction area, and the desirable by-product is "deposited" or "grown" on the exposed surfaces of the substrates. The deposited film material is necessarily thin, and quite routinely referred to in the prior art as a "thin film," being on the order of a few thousand angstroms thick. (See, e.g., Handbook of Thin Film Technology, Maissel and Glang, 1970, LCCN 73-79497.) Substrate 25 acts as the mechanical structure on which a newly created porous heating film 23 is grown. It should be noted that the porous heater film, as it is created within the reactor, would be of little value or use if not for the presence of supporting porous substrate 25. The present invention leverages this dependency of the creation (thin film growth) of the porous heater element 23 upon the presence of a porous substrate 25, and this is an important differentiator between thin film heaters, such as described herein, and thick film or other mechanically based heater designs (e.g., formed wire heaters), in which the heating element is self-supporting and exists independent of any body onto which it may be applied.

Although heater film 23 is preferably created using a method termed Atmospheric Pressure Chemical Vapor Deposition (APCVD), a method that has wide use in the semiconductor manufacturing industry, it may not be the only method in which porous film 23 may be made. Other know methods, such as vacuum evaporation, sputtering, conventional CVD, plasma CVD, or even flame pyrolysis might be employed.

As shown in FIG. 1, resistance heater film 23 is electrically connected to a source of electricity 31 by bus bars 33 and electrical conductors 35. Heater 21 would further include control circuitry (not shown) and most preferably a structure channeling or directing fluid flow 27 through porous film 23 and porous substrate 25. Usually fluid flow through heater 21 would be accompanied by maintaining a pressure differential across the film and substrate by a pump, blower, fan, vacuum device or a combination of such equipment, all of which are well known in the art.

Thus, resistance heating of a fluid as it passes through the regions in which the film coating is present occurs. Other properties for which the porous materials were initially designed would still also be present, such as filtering, diffusing, or merely providing mechanical load bearing at a reduced overall weight.

Figure 2A:
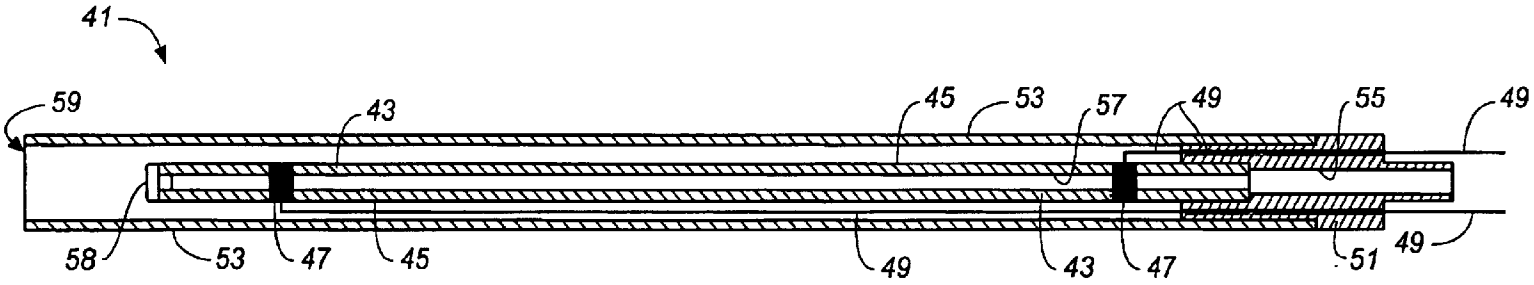
FIG. 2A is a schematic, side elevation view, in cross section, of another embodiment of the porous thin film heater of the present invention.
Figure 2B:
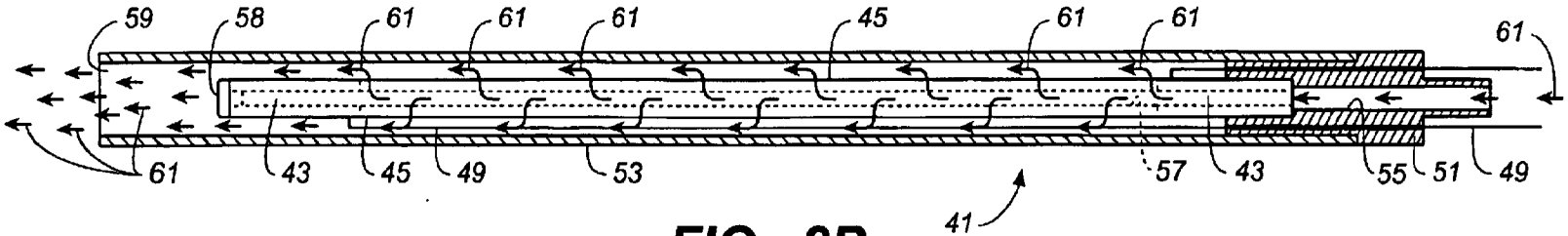
FIG. 2B is a side elevation view corresponding to FIG. 2A and showing flow of a fluid through the heater.

Turning now to FIGS. 2A and 2B an alternative embodiment of the porous thin film heater assembly of the present invention is shown. In heater assembly 41 a porous ceramic tube 43 is used as the substrate onto which a thin electrically conductive film 45 is deposited. Film 45 is deposited on the outer surface of tube 43, and since it does not fill the pores of the tube, film 45 itself forms a porous coating through which fluids can pass. Bus bars 47 are provided at opposite ends of the tube in electrical contact with porous thin film (it being understood that there are many electrical paths along the porous film between bus bars 47). Electrical conductors or leads 49 are connected to the bus bars and pass axially out through fitting 51, which is mounted in one end of the fluid containing glass tube 53. Fitting 51 may be formed of an insulating material or a metal fitting, through which insulated leads 49 pass.

In order to direct fluid through heater 41, fitting 51 includes a central bore 55 which is in fluid communication with central bore 57 of ceramic tube 43. A plug or closure member 58 is mounted in the end of ceramic tube 43 remote from fitting 51.

Heater 41 was built to heat air, such as might be done in a hair dryer, or to act as a gas heater, as might be used in the semiconductor manufacturing industry. Heater 41 was constructed by depositing a doped tin oxide film 45 on ceramic tube 43. Bus bars 47 were applied, and one end of the tube was sealed at 58. This was then installed on fitting 51 through which supply air was pumped. The entire assembly was then covered with glass tube 53 to direct the air out in one location, namely, open end 59. Flow of air through heater 41 is shown in FIG. 2B by arrows 61, and Tables 1 and 2 show the test results regarding performance of heater 41 in low and high power heating conditions.

TABLE 1

Low Power versus Temperature (Degrees C.) for Four Flow Settings

| 10 SCFH | | 20 SCFH | | 40 SCFH | | 50 SCFH | |
|---|---|---|---|---|---|---|---|
| watts | temp | watts | temp | watts | temp | watts | temp |
| 2.85 | 49.40 | 2.55 | 38.40 | 2.55 | 31.60 | 2.85 | 33.00 |
| 5.39 | 68.00 | 4.41 | 52.30 | 4.41 | 40.20 | 5.39 | 40.30 |
| 9.15 | 90.60 | 6.72 | 67.30 | 6.72 | 50.00 | 9.15 | 48.60 |
| 12.41 | 110.00 | 9.48 | 86.60 | 9.48 | 59.40 | 12.41 | 51.50 |
| 16.78 | 136.30 | 13.46 | 104.50 | 13.46 | 73.20 | 16.78 | 60.40 |

TABLE 2

High Power versus Temperature (Degrees C.) for Two Flow Settings

| 20 SCFH | | | 40 SCFH | |
|---|---|---|---|---|
| Heater Power Watts | Outlet Gas Temp | Heater Surface Temp | Outlet Gas Temp | Heater Surface Temp |
| 15.96 | 101.4 | 126.5 | 74.6 | 82.6 |
| 33.63 | 157.3 | 209.5 | 112.7 | 136.6 |
| 59.27 | 244.0 | 322.0 | 178.7 | 213.4 |
| 73.88 | 277.0 | 362.0 | 222.0 | 256.7 |
| 90.05 | | | 257.0 | 301.0 |
| 105.46 | | | 289.0 | 346.0 |

The flow rates through heater 41 are shown in standard cubic feet per hour (SCFH).

In porous thin film heater 41 of the present invention, the porous substrates ceramic tube 45, spreads out the gas over a much larger surface area than the delivery tube inner diameter or bore 57 of the tube. This tubular construction has the effect of slowing the gas stream down thereby extending the contact time at the outer surface with heater film 45. This allows operation of the heater element 45 at a lower surface temperature, reducing the chances of altering the composition of the gas species due to is contacting a heater element at very high temperatures.

As will be understood, therefore, from the above description of the porous thin film heaters of the present invention, the method of the present invention includes the step of forming a thin electrically conductive film on a porous electrically insulative substrate to produce a porous thin film resistance heater. This most preferably is accomplished by growing or depositing the film on the substrate in a film depositing reactor. The substrate provides the self-supporting mechanical strength for the thin film heater, and the pores of the substrate cause the thin film to be porous so that fluids, gases or liquids, can flow slowly through, and be in direct contact with, the porous thin film heater element. This further enables more efficient transfer of heat to the fluid and allows for heater element temperature reduction.

The present method also preferably includes the steps of electrically coupling the porous thin film to a source of electricity, and passing a fluid through the porous film and the porous substrate while applying electricity to the film to produce resistance heating of the fluid.

The porous substrate also can be used to effect filtering and/or dispersion of the fluid as the fluid is being heated.

Advantageously, a porous thin film heater in accordance with the present invention is particularly suited to provide more uniform heating of fluids. The porous thin film heater can also be used to mix fluids passing therethrough. For example, as two chemical reactants pass though the heater, the reactants mix and react for thorough reaction thereof. The porous thin film heater can also be used to disperse fluid absorbed within the heater. For example, the absorbed fluid can be dispersed when heated into a fluid. A further advantage of the present invention is that less power is required to operate the porous thin film heater because it is more efficient than conventional heaters. Furthermore, the porous thin film heater can be safer to use than conventional heaters because the temperature of the heater can be below the flash ignition point of some fluids.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A resistance heater comprising: a fluid-permeable porous substrate; an electrically conductive thin film deposited on said porous substrate; thereby forming a porous flow-through heater element; and an electrical connector coupled to said thin film adapted to provide an electrical circuit through said thin film to effect heating of said thin film.

2. The resistance heater of claim 1 wherein said substrate includes an electrically non-conductive surface.

3. The resistance heater of claim 1 wherein said substrate is tubular.

4. The resistance heater of claim 1 wherein said substrate is ceramic.

5. The resistance heater of claim 1 wherein said substrate is self-supporting.

6. A resistance heater comprising:

a fluid-permeable porous substrate;

an electrically porous conductive thin film deposited on said porous substrate; and an electrical connector coupled to said thin film adapted to provide an electrical circuit through said thin film to effect heating of said thin film;

wherein said porous substrate includes a pore size and said thin film includes a thickness, said thin film having a thickness less than said pore size wherein pores of said substrate are not clogged or closed by said thin film.

7. The resistance heater of claim 1 wherein said thin film is tin oxide.

8. The resistance heater of claim 1 wherein said electrical connector includes a bus bar connected to an electrical conductor adapted for connection to a source of electricity.

9. The resistive heater of claim 1 further comprising a fluid directing structure proximate said porous substrate adapted to direct fluid flow through said porous substrate.

10. A resistance heater comprising:

a tubular housing;

a tubular and fluid-permeable porous substrate disposed within said tubular housing, said tubular substrate having first and second ends, an electrically conductive thin film deposited as a porous surface on said porous substrate;

first and second bus bars proximal said first and second ends of said porous substrate, respectively, said bus bars electrically coupled to said thin film;

a fitting securing said first end of said porous substrate relative to said tubular housing, said fitting including a central bore;

first and second electrical conductors electrically connected to said first and second bus bars, respectively, said conductors passing axially through said fitting and adapted to be coupled with a source of electricity; and a closure member closing said second end of said porous substrate wherein fluid passing through said resistance heater passes through said fitting bore, said porous substrate and said tubular housing, respectively.

11. The resistance heater of claim 10 wherein said tubular housing is glass.

12. The resistance heater of claim 10 wherein said porous substrate is ceramic.

13. The resistance heater of claim 10 wherein said thin film is tin oxide.

14. A method of forming a resistance heater comprising the steps: providing a fluid-permeable porous substrate; depositing an electrically conductive thin film on said porous substrate to provide a thin film supported on said porous substrate, thereby forming a porous flow-through heater element; and coupling an electrical connector to said thin film to provide a circuit through said thin film.

15. The method of claim 14 wherein said depositing step is accomplished by forming a thin film of tin oxide from one or more of the following precursors and dopants: tin chloride, methyl alcohol, H2O, di-fluoroethane and antimony pentachloride.

16. The method of claim 14 wherein said depositing step is accomplished by reacting vaporous precursors together in a high temperature process reactor and conveying said substrate through said process reactor to form said thin film on said substrate.

17. The method of claim 14 wherein said depositing step is accomplished by one or more of the following: chemical vapor deposition, atmospheric pressure chemical vapor deposition, vacuum evaporation, sputtering, plasma chemical vapor deposition and flame pyrolysis.

18. A method of heating a fluid comprising:

providing a resistance heater formed by the method of claim 14;

coupling said conductive film to a source of electricity and increasing the temperature of said thin film by resistive heating; and passing a fluid through said resistance heater to effect heating of the fluid.

19. A method of heating a fluid comprising:

providing a resistance heater formed by the steps:

(i) providing a fluid-permeable porous substrate;

(ii) depositing an electrically conductive thin film on said porous substrate to provide a porous thin film supported on said porous substrate; and (iii) coupling an electrical connector to said thin film to provide a circuit through said thin film;

coupling said conductive film to a source of electricity and increasing the temperature of said thin film by resistive heating; and passing a fluid through said resistance heater to effect heating of the fluid;

wherein said passing step is accomplished by maintaining a pressure differential across said substrate and said film with one or more of the following: a pump, a blower, a fan and a vacuum.

20. A method of heating a fluid comprising:

providing a resistance heater formed by the steps:

(i) providing a fluid-permeable porous substrate;

(ii) depositing an electrically conductive thin film on said porous substrate to provide a porous thin film supported on said porous substrate; and (iii) coupling an electrical connector to said thin film to provide a circuit through said thin film;

coupling said conductive film to a source of electricity and increasing the temperature of said thin film by resistive heating; and passing a fluid through said resistance heater to effect heating of the fluid; wherein said passing step simultaneously heats the fluid and filters the fluid.

* * * * *